US011298702B2

(12) United States Patent
Wasier et al.

(10) Patent No.: US 11,298,702 B2
(45) Date of Patent: Apr. 12, 2022

(54) METHOD FOR DISSOCIATING DIFFERENT CONSTITUENTS OF A HETEROGENEOUS ARTIFICIAL MATERIAL

(71) Applicant: FIVES FCB, Villeneuve d'Ascq (FR)

(72) Inventors: Etienne Wasier, Villeneuve d'Ascq (FR); Alain Fruchart, Villeneuve d'Ascq (FR); Jérôme Portal, Villeneuve d'Ascq (FR)

(73) Assignee: FIVES FCB, Villeneuve d'Ascq (FR)

( * ) Notice: Subject to any disclaimer, the term of this patent is extended or adjusted under 35 U.S.C. 154(b) by 0 days.

(21) Appl. No.: 16/977,688

(22) PCT Filed: Mar. 1, 2019

(86) PCT No.: PCT/FR2019/050470

§ 371 (c)(1),
(2) Date: Nov. 17, 2020

(87) PCT Pub. No.: WO2019/166746

PCT Pub. Date: Sep. 6, 2019

(65) Prior Publication Data

US 2021/0053067 A1 Feb. 25, 2021

(30) Foreign Application Priority Data

Mar. 2, 2018 (FR) ..... 18 51842

(51) Int. Cl.

| | |
|---|---|
| ***B02C 2/00*** | (2006.01) |
| ***B02C 2/04*** | (2006.01) |
| ***B02C 25/00*** | (2006.01) |

(52) U.S. Cl.
CPC ..... *B02C 2/045* (2013.01); *B02C 25/00* (2013.01); *B02C 2002/002* (2013.01)

(58) Field of Classification Search
CPC .... B02C 25/00; B02C 2/045; B02C 2002/002
See application file for complete search history.

(56) References Cited

U.S. PATENT DOCUMENTS 4,964,580 A * 10/1990 Akesaka ..... B02C 2/00 241/252
5,035,368 A * 7/1991 Finley ..... B02C 2/06 241/212

(Continued)

FOREIGN PATENT DOCUMENTS

JP H09262489 10/1997
JP 2007-261870 10/2007

(Continued)

*Primary Examiner* — Faye Francis
(74) *Attorney, Agent, or Firm* — Nixon & Vanderhye

(57) ABSTRACT

Disclosed is a method for dissociating different constituents of a heterogeneous artificial material, including the fragmentation of the material in a fragmentation machine by material-bed compression, the machine including at least one vibrator and a system for controlling at least one parameter of the fragmentation force from the speed of rotation of the vibrator and the phase shift angle between at least two vibrators. The control system adjusts a rotation parameter of the vibrators so as to generate a fragmentation force by the machine allowing to at least partially dissociate at least one of the constituents of the material from the other constituents.

40 Claims, 4 Drawing Sheets

(56) References Cited

U.S. PATENT DOCUMENTS

| | | | | | |
|---|---|---|---|---|---|
| 5,575,428 | A * | 11/1996 | Cordonnier | B02C 2/04 | 241/30 |
| 5,996,915 | A * | 12/1999 | Cordonnier | B02C 2/042 | 241/207 |
| 7,815,133 | B2 * | 10/2010 | Belotserkovsky | B02C 2/042 | 241/30 |
| 7,954,735 | B2 * | 6/2011 | Belotserkovsky | B02C 2/042 | 241/30 |
| 2010/0327093 | A1 * | 12/2010 | Belotserkovsky | B02C 2/042 | 241/30 |
| 2015/0129696 | A1 * | 5/2015 | Andrienko | B02C 2/042 | 241/215 |
| 2015/0210594 | A1 | 7/2015 | Achenbach | | |
| 2018/0036736 | A1 * | 2/2018 | Andrienko | B02C 2/042 | |
| 2020/0023372 | A1 * | 1/2020 | Portal | B02C 2/045 | |

FOREIGN PATENT DOCUMENTS

| | | |
|---|---|---|
| JP | 2009-013016 | 1/2009 |
| WO | 2011/142663 | 11/2011 |
| WO | 2015/051925 | 4/2015 |
| WO | 2016/122323 | 8/2016 |
| WO | 2016/122324 | 8/2016 |

* cited by examiner

METHOD FOR DISSOCIATING DIFFERENT CONSTITUENTS OF A HETEROGENEOUS ARTIFICIAL MATERIAL

CROSS-REFERENCE TO RELATED APPLICATIONS

This application is the U.S. national phase of International Application No. PCT/FR2019/050470 filed Mar. 1, 2019 which designated the U.S. and claims priority to French Patent Application No. 18 51842 filed Mar. 2, 2018, the entire contents of each of which are hereby incorporated by reference.

BACKGROUND OF THE INVENTION

Field of the Invention

The invention relates to the field of recycling artificial materials, that is to say materials obtained from a method implemented by man, as the final product of this method or not. More specifically, the invention relates to the field of heterogeneous artificial materials, that is to say produced from the mixture of several constituents, at least part of which can be found in the material without modifying their structure.

Description of the Related Art

Concrete is an example of a heterogeneous artificial material. Even more specifically, cement concrete typically comprises a gravel, or comprising rock fragments, trapped in a mortar, which is in turn generally a mixture of sand and a cement paste acting as a hydraulic binder.

Cement concrete is widely used in construction and infrastructure works, that is to say for example buildings, roads and engineering structures. However, the production of cement concrete involves the exploitation of natural resources, in particular minerals to extract the aggregate, comprising gravel and sand. The impact on the environment is therefore not negligible, in particular because of the exploitation of non-renewable natural resources, but also because of the pollution and nuisances caused by the transport of these resources from their place of extraction until the site where they are used to produce concrete. Demolition waste must also be landfilled. Such landfill sites, in addition to their impact again on the environment, are also the subject of negative sentiment from the public opinion.

As sustainable development has become a strategic issue, various countries have already encouraged, or even imposed, the use of a portion of recycled cement concrete in new structures, in order to develop short circuits. Recycled cement concrete means cement concrete obtained from at least one constituent of an initial concrete that has previously been poured and dried to produce a structure, which structure is then demolished.

The production of recycled concrete nevertheless remains complex, in particular because of the presence of undesirable materials in the initial concrete, such as metal pieces, if the upstream sorting has not been correctly carried out and also because of a demand for more water than for concrete not using recycled gravel because of the fracturing of the gravel and the porosity of the old mortar, the mortar being the mixture of sand and cement paste. Furthermore, the presence of the old mortar reduces the performance of the resulting concrete, in particular with less resistance to fragmentation compared to non-recycled concrete.

To produce recycled cement concrete, it is therefore important to separate the various constituents of the initial concrete, namely in particular the gravel from the mortar, to reuse the gravel in the formulation of the recycled concrete. The mortar must therefore be separated from the gravel, without breaking the gravel to avoid the production of finer particles that cannot be reused as gravel. Optionally, it is desirable to recover the sand from the mortar, which is also reusable.

Different techniques have been proposed to produce recycled cement concrete.

For example, it has been proposed either to heat the water in the concrete by providing microwaves to evaporate it and facilitate the separation between the gravel and the mortar, or to pass a very high voltage electric discharge through the material, a technology that plays on the differences in electrical conductivity between materials to generate fractures at the interfaces. The concrete thus "pretreated" is then crushed to release the gravel. However, in these two solutions, a provision of energy is required, which slows down their development in particular because of costs, but also because of their technological complexity.

It has also been proposed to use the technology of grinding-crushing-fragmentation apparatuses, referred to below as a fragmentation machine.

It is for example known to use a jaw fragmentation machine, that is to say comprising two jaws hinged relative to one another so as to fragment the material by bringing the jaws closer together. Document JP2007-261870 gives an example of such a machine, wherein the filling rate of the fragmentation area, between the two jaws, is adjusted by regulating the speed of a belt for feeding the material to the fragmentation machine and the speed of an output belt recovering the fragmented material at the output of the fragmentation machine. Thus, the residence time of the material between the jaws is adjusted to obtain the release of the gravel. Document WO2011/142663 also proposes to use a jaw fragmentation machine wherein the residence time of the material between the jaws is regulated by a vertical movement of one of the jaws relative to the other. Document WO2016/122324 proposes to blow air between the jaws in order to carry fine particles away and to optimise the fragmentation energy for the material remaining between the jaws.

These solutions with a jaw fragmentation machine are not entirely satisfactory, because in practice the gravel is not sufficiently released from the mortar to be able to be reused in a new concrete with satisfactory features. Thus, a complementary device such as that described in document WO2016/122323 is often implemented after the jaw fragmentation machine, wherein the material leaving the fragmentation machine is subjected to vibrations in order to further release the gravel. Such an additional device increases the size of an installation and the energy consumption.

It is also known to use a fragmentation machine comprising rotating cylinders on a material bed. Document WO 2015/051925 provides an example of such use. According to this document, the pressure of the cylinders is adjusted in such a way that the constraints applied to the grinding bed by the cylinders allow the separation of materials by mutual friction and by using the phenomenon of attrition. This solution is still not entirely satisfactory in practice.

From document US 2015/0210594, it is also known to introduce concrete into a rotating drum. A combustion gas comprising $CO_2$ is injected into the drum. The $CO_2$ reacts with the cement paste of the concrete at 75° C., and the rotation of the drum ensures the continuous fragmentation of the concrete, so that new surfaces are continuously exposed to the $CO_2$. The concrete is also bathed in water in the drum, so that it is almost 100% saturated with water. The reaction products comprise calcium carbonate and aggregate which are discharged from the drum onto a conveyor. Such a solution is complex to implement and consumes a lot of energy. It further requires a step of drying the material recovered at the output of the drum before being able to sort the reaction products, and therefore the aggregate comprising the gravel, generating additional costs.

SUMMARY OF THE INVENTION

There is therefore a need for a new method allowing in particular to release the gravel from the mortar of a concrete previously used in a structure, and more generally to dissociate the constituents of a heterogeneous artificial material, in order to be able to produce a new recycled material.

To this end, a first object of the invention is to propose a method for dissociating different constituents of a heterogeneous artificial material allowing to recover at least one of the constituents for reuse by means of a fragmentation machine.

A second object of the invention is to propose such a method which does not require any additional device for dissociating the constituents.

A third object of the invention is to propose such a method with increased control of the quality of dissociation between the constituents, and therefore increased reliability.

A fourth object of the invention is to propose such a simplified method.

A fifth object of the invention is to propose such a method with flexibility relative to the constituents to be dissociated, in order to easily adapt the settings of the fragmentation machine to the material to be fragmented.

Thus, according to a first aspect, the invention proposes a method for dissociating different constituents of a heterogeneous artificial material. In particular, the method comprises the fragmentation of the material in a fragmentation machine by material-bed compression under the effect of a fragmentation force. The machine includes:

- a tank forming an internal fragmentation track about a longitudinal axis of the machine;
- a hub forming an external fragmentation track about a longitudinal axis of the machine, the hub being placed inside the tank;
- at least one vibrator, rotated about a longitudinal axis of the machine, and connected to one or the other of the tank and the hub;
- a system for controlling at least one parameter of the fragmentation force from the speed of rotation of the vibrator(s) and the phase shift angle between at least two vibrators.

The method then comprises:

- rotating the vibrator(s) of the fragmentation machine, such that the tank performs a movement in a transverse plane of the machine relative to the hub;
- feeding the fragmentation machine with material to be fragmented;
- fragmenting the material between the external fragmentation track and the internal fragmentation track.

The control system adjusts at least one rotation parameter of the vibrators so as to generate a fragmentation force by the machine allowing to at least partially dissociate at least one of the constituents of the material from the other constituents.

Thus, the fragmentation force deployed between the internal track and the external fragmentation station of the machine is regulated so as to release one of the constituents of the heterogeneous material from the matrix formed by the other constituents. The constituent released can then be directly valorised, without necessarily an additional cleaning step.

The design of the machine allows the fragmentation force to be quickly adjusted, so that it can be regulated quickly, without having to stop the machine in operation, for example when the release of the constituent in question does not comply with a desired result.

Furthermore, the adjustment of the fragmentation force on the machine allows the method to be adapted to any type of material, depending on the nature of its constituents.

According to one embodiment, the hub is of a substantially conical shape and wherein the machine comprises:

- a frame intended to rest on the floor, the hub being supported by the frame;
- a chassis movable in translation at least in a transverse plane of the machine relative to the frame, the tank being mounted on the movable chassis;
- at least one vibrator mounted on the chassis, and rotated about a longitudinal axis of the machine.

Advantageously, the machine can comprise:

- at least two vibrators mounted on the chassis, each vibrator being rotated about a longitudinal axis of the machine by a motor, each motor driving the vibrator to which it is associated independently of each other;
- a device for managing the motors and a device for measuring the relative phase shift angle between the vibrators.

The method according to this embodiment can then comprise the adjustment of the relative phase shift angle between the vibrators by the control system to obtain the dissociation of at least one constituent. Thus, the fragmentation force deployed by the machine is adjusted by the phase shift angle between the vibrators. Regulating the phase shift angle between the vibrators allows fine and precise adjustment of the fragmentation force. Indeed, as each vibrator is driven independently of the others by an associated motor, the speed and the position of the vibrators relative to each other can be controlled with precision, and maintained throughout the operating time of the machine with great reliability, guaranteeing the release of a constituent from the starting material according to a desired result, and preserved during the time of operation of the machine.

The target fragmentation force can be determined in various ways. Two embodiments are given below as an example, and may optionally be implemented in combination.

Thus, according to one embodiment, the at least one rotation parameter of the vibrators is adjusted in the following manner:

- determining in the material to be fragmented a target ratio between at least one constituent and the other constituents;
- recovering the fragmented material at the output of the fragmentation machine;
- determining at least one sorting criterion allowing to separate the at least one constituent from the other constituents;
- subjecting the fragmented material to a sorting by means of said sorting criterion determined so as to recover at least two fractions;
- determining an actual ratio between the at least two fractions;

adjusting the at least one rotation parameter of the vibrators according to the difference between the target ratio and the actual ratio.

Indeed, the theoretical ratio of the various constituents of the starting heterogeneous material is very often known, or at least an evaluation is possible. Consequently, by comparing the theoretical ratio with the actual ratio, the method allows to evaluate the result of the release of one of the constituents, and to regulate the fragmentation force of the machine accordingly to obtain the desired result.

According to another embodiment, the at least one rotation parameter of the vibrators is adjusted in the following manner:

determining at least one property of at least one constituent of the material;

from said determined property, calculating a target force allowing to dissociate the at least one constituent from the other constituents;

adjusting the at least one rotation parameter of the vibrators to obtain the target force.

Indeed, for example, it is possible to determine, depending on the constituent to be released, some of its properties, such as the shape, the size, the hardness and/or the compressive strength. These properties can then be used to evaluate a target fragmentation force, that will allow to break the bond between the constituent to be released and the other constituents of the starting material, and adjust the rotation of the vibrator(s) accordingly.

According to one embodiment, it is possible to recover all or part of at least one fraction of the fragmented material which is recirculated to the feed to the fragmentation machine.

Thus, for example, the method can further comprise the following steps:

determining at least one target flattening coefficient for at least one constituent of the material to be fragmented;

recovering said at least one constituent after fragmentation;

measuring said flattening coefficient of said at least one constituent;

adjusting the flow rate and/or the granulometry range of the at least one fraction recirculated depending on the difference between the determined flattening coefficient and the measured flattening coefficient.

Alternatively or in combination, the method may further comprise the following steps:

determining a cleaning rate for at least one constituent of the material to be fragmented;

recovering said at least one constituent after fragmentation;

measuring said cleaning rate of said at least one constituent;

adjusting the flow rate and/or the granulometry range of the at least one fraction recirculated depending on the difference between the determined cleaning rate and the measured cleaning rate.

According to one possible application, the material to be fragmented is concrete and comprises a first constituent called gravel and a second constituent called mortar. The gravel is said to be trapped in the mortar, that is to say that the cohesion between the gravel particles is at least partly ensured by the mortar. The method can therefore comprise determining a target fragmentation force generating a constraint in the bed-material greater than or equal to the compressive strength of the concrete. Indeed, it is observed that the compressive strength of concrete is mainly given by the bond between the gravel particles and mortar. By measuring its compressive strength on the concrete before fragmentation and by adjusting the fragmentation force deployed by the fragmentation machine accordingly, the separation between the gravel particles and mortar is obtained.

According to one embodiment, still wherein the material to be fragmented is concrete, the method may comprise:

recovering gravel and mortar from the fragmentation machine;

subjecting the gravel and mortar to a sorting between particles called coarse particles of a size greater than a given value corresponding to the minimum expected size of the gravel and particles called fine particles of a size less than said given value.

The fine particles then comprise sand, which can also be valorised. Thus, according to one embodiment, the fine particles are subjected to a second sorting to separate, on the one hand, particles of a size less than a second given value corresponding to the minimum expected size for sand and, on the other hand, the particles of a size greater than said second given value.

Optionally, when the sand particles have not been sufficiently released from the cement paste, the fine fraction can be subjected to a second fragmentation step and to a sorting step to separate particles of a size greater than a second given value corresponding to the minimum expected size for sand and the particles of a size less than said second given value.

BRIEF DESCRIPTION OF THE DRAWINGS

Other effects and advantages of the invention will become apparent in light of the description of embodiments accompanied by figures wherein.

DESCRIPTION OF THE PREFERRED EMBODIMENTS

Figure 1:
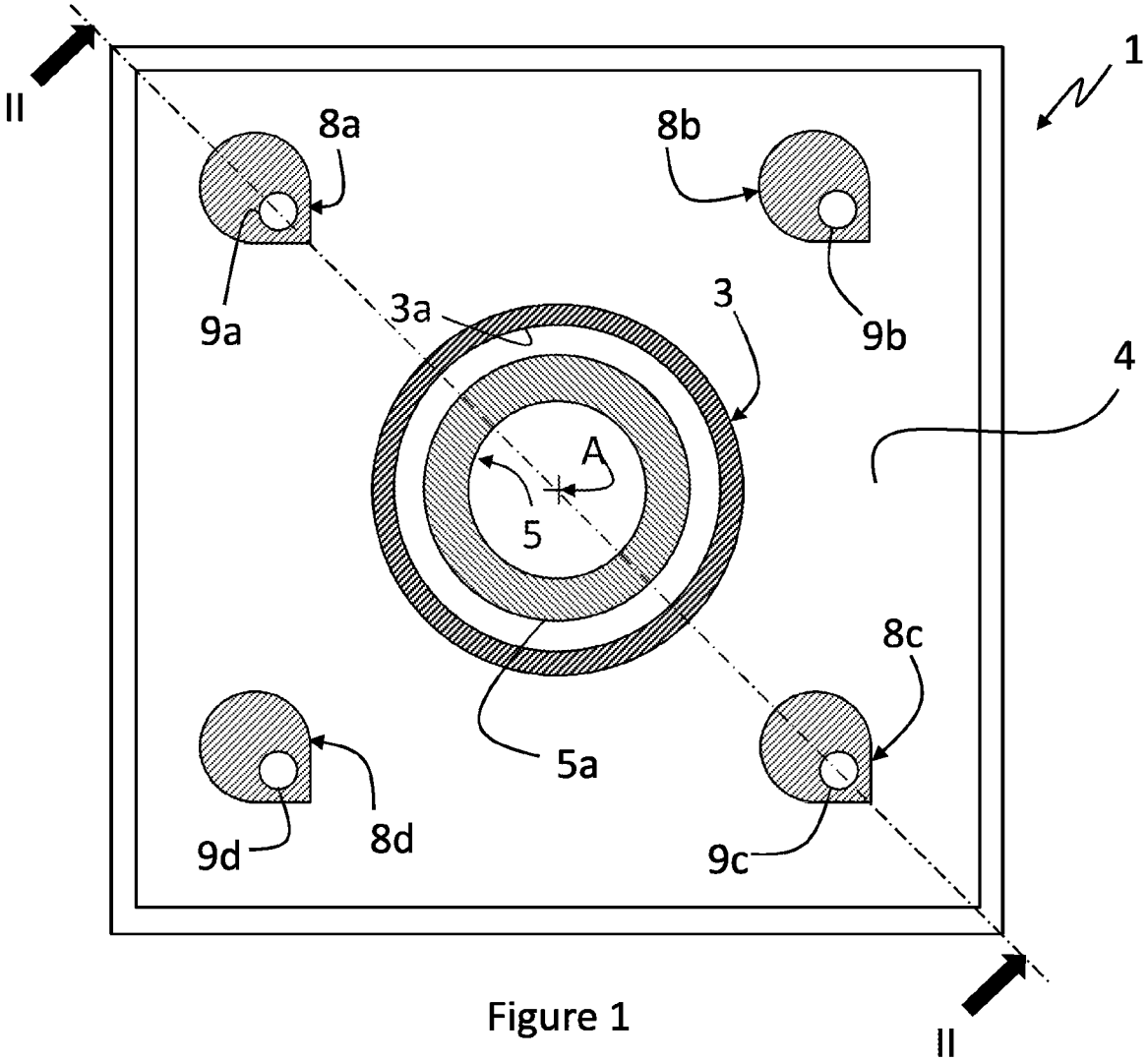
FIG. 1 is a schematic representation, in top view, of a fragmentation machine for implementing an embodiment of the method according to the invention.
Figure 2:
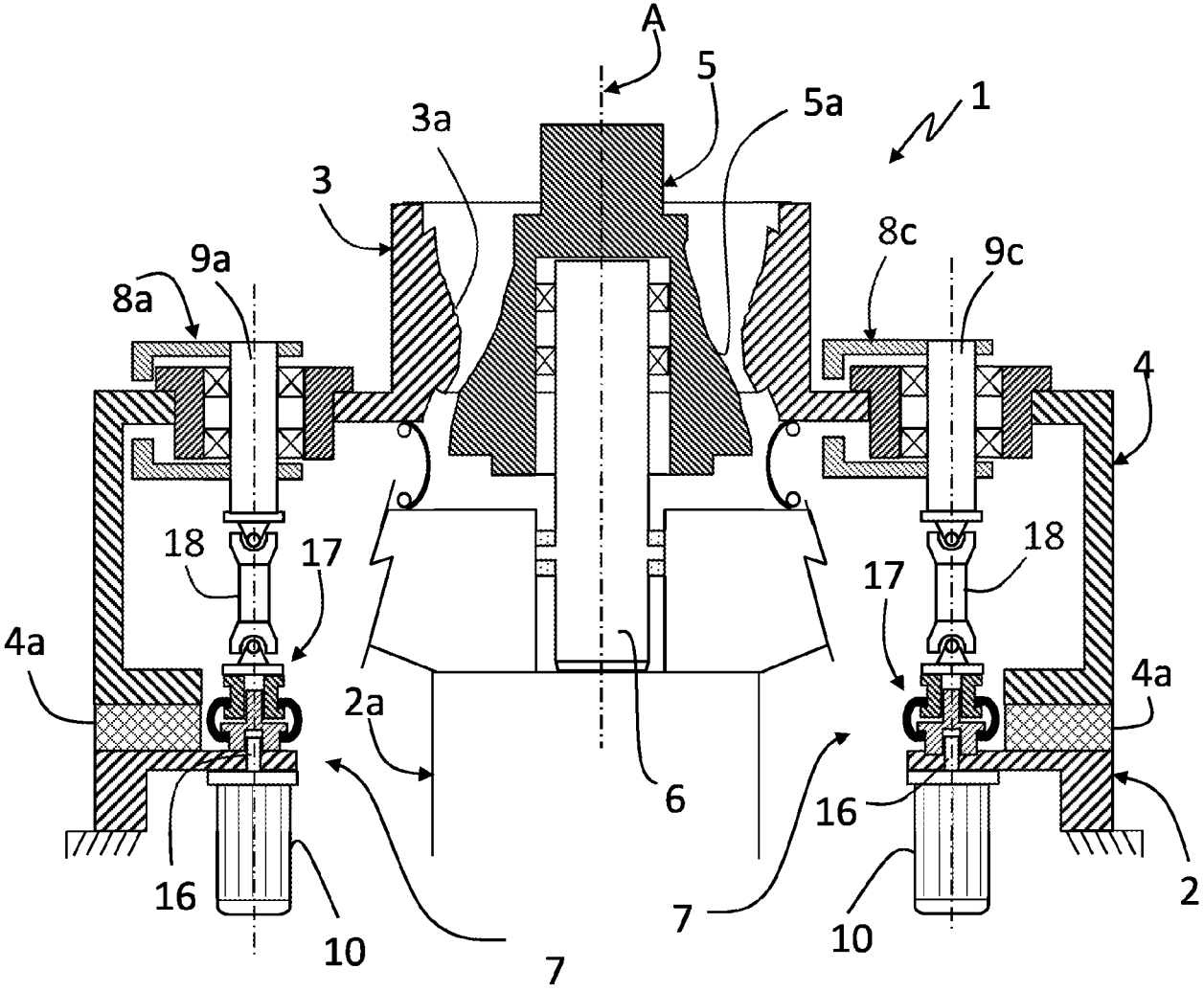
FIG. 2 is a sectional view along line II-II of the machine of FIG. 1.

FIGS. 1 and 2 show an example of a fragmentation machine 1 for a heterogeneous artificial material by material-bed compression adapted for implementing the method according to the invention. Fragmentation by material-bed compression is particularly, but not exclusively, adapted for the fragmentation of mineral materials.

Heterogeneous material here means a material comprising several constituents interconnected so as to form a block. In other words, by considering one of the constituents, it can be seen as being trapped in a matrix formed from the other constituents.

Generally, the constituents of a heterogeneous material can be distinguished according to their properties, for example their dimensions, their shape, their porosity, their wear resistance, their compressive strength or their hardness.

For the sake of simplification, the following description relates to the example of cement concrete as a heterogeneous artificial material, it being understood that the method which is the subject of the invention is not limited to this example. Thus, in what follows, it is considered that the cement concrete comprises aggregate particles trapped in the cement paste. The aggregate particles meet established criteria, such as those established in standard EN12620, and thus comprise gravel particles and sand particles, it being expected that the gravel particles are larger in size than those of the sand particles. Commonly, the mixture of sand and cement paste is called mortar, the mortar trapping the gravel.

The fragmentation machine 1 comprises in particular a frame 2, intended to rest directly on the floor, or indirectly via a movable platform resting on the floor. In addition, the machine 1 comprises a tank 3, the inner surface of which forms an interior fragmentation track 3*a*. The tank 3 is mounted on a chassis 4 which is movable in translation relative to the frame 2 at least in a transverse plane, which is in practice substantially the horizontal plane. To this end, the chassis 4 is mounted on the frame 2 via elastic studs 4*a*, deforming elastically both transversely and longitudinally to limit the transmission of vibrations to the frame 2. A hub 5, the outer surface of which forms an external fragmentation track 5*a*, is placed inside the tank 3. Preferably, the hub 5 is mounted on a shaft 6 extending along a longitudinal axis A, which is in practice substantially vertical, and supported by a secondary frame 2*a*. The secondary frame 2*a* is suspended from the chassis 4.

In what follows, longitudinal designates any axis parallel to the longitudinal axis A of the shaft 6, and transverse designates any direction perpendicular to the longitudinal axis A.

According to the machine of the example of FIGS. 1 and 2, and without limitation, the hub 5 is of a substantially conical shape. More specifically, the external track 5*a* describes a surface of revolution about the longitudinal axis A which is substantially conical, widening downwards. In this case, and advantageously, the internal track 3*a* also describes a surface which is substantially conical around a longitudinal axis, widening upwards.

The machine 1 is of the inertia type and to this end comprises a device 7 for vibrating the tank 3 relative to the frame 2 in a transverse plane. Thus, under the effect of the vibrating device 7, the tank 3 displaces in a transverse plane relative to the hub 5, so that the material is subjected to a fragmentation pressure between the internal track 3*a* and the external track 5*a*. According to one embodiment, the vibrating device 7 comprises at least one unbalance-type vibrator whose rotation about a longitudinal axis generates the movement of the tank 3 relative to the hub 5 in a transverse plane. Preferably, the vibrating device 7 comprises at least two vibrators.

More specifically, vibrator means here any device whose mass is not perfectly distributed over a volume of revolution and thus generates an unbalance force by rotation.

According to an embodiment which is that of the figures, the vibrating device 7 comprises four vibrators 8*a*, 8*b*, 8*c*, 8*d* distributed in a square on the chassis 4. Each vibrator 8*a*, 8*b*, 8*c*, 8*d* can be formed of two parts distributed on either side of a substantially transverse plane of the chassis 4, so that the vibrations of the tank 3 caused by the rotation of the vibrators 8*a*, 8*b* 8*c*, 8*d* remain substantially in this transverse plane. Each vibrator 8*a*, 8*b*, 8*c*, 8*d* is fixed on a shaft 9*a*, 9*b*, 9*c*, 9*d* with a longitudinal axis vibrator rotated relative to the chassis 4 by a motor 10, whose motors 10 of the vibrator shafts 9*a*, 9*b* are visible in FIG. 2. Thus, when the vibrators are rotated, the tank 3 is vibrated and describes a circular translational movement in a transverse plane.

Each motor 10 drives the corresponding vibrator independently of the other vibrators. More specifically, each motor 10 drives the position and the speed of rotation of the corresponding vibrator. Thanks to one or more sensors, it is possible to know at any time the position of each of the vibrators, and therefore to adjust the relative angular position between two vibrators, also called phase shift. Thus, each motor 10 is connected to a motor management device 10 so as to adjust the speed of rotation of the vibrators 8*a*, 8*b*, 8*c*, 8*d*. The machine 1 further comprises a device for measuring the relative phase shift angle between the vibrators 8*a*, 8*b*, 8*c*, 8*d*, which is connected to the motor management device 10 so as to control the phase shift between the vibrators 8*a*, 8*b*, 8*c*, 8*d*.

According to a variant, not shown in the figures, the vibrating device 7 comprises two vibrators rotated by a common motor and about the same longitudinal axis. The phase shift between the two vibrators, that is to say the relative angular position around their axis of rotation, is adjustable, for example manually when the machine is stopped or automatically during operation of the machine.

It is then possible to precisely adjust the force called the fragmentation force deployed by the fragmentation machine 1, that is to say the force deployed between the internal track 3*a* and the external track 5*a* by adjusting the rotation parameters of the vibrators. Indeed, in the fragmentation machine 1, the relative whose movement between the external fragmentation track 3*a* and the internal fragmentation track 5*a* is obtained by implementing a vibrator, the force deployed by the machine depends in particular on the frequency and the intensity of the vibrations, which in turn depend in particular on the speed of rotation of the vibrator, but also, when there are at least two vibrators, on the phase shift between the at least two vibrators.

Thus, the machine 1 further comprises a system 11 for controlling at least one parameter of the fragmentation force from the speed of rotation of the vibrator(s) and the phase shift angle between at least two vibrators. The fragmentation force implemented by the fragmentation machine 1 can thus be adjusted by adjusting the vibrators so as to release the aggregate from the concrete.

More specifically, it is possible to directly or indirectly determine a target force, or a range of values of the target force, of fragmentation to obtain the dissociation of the constituents of the material.

More generally, the fragmentation machine 1 with the fragmentation force adjusted as described allows to at least partially dissociate one constituent from the other constituents of the starting heterogeneous material, and to recover the original constituent in question. "At least partially dissociate" means here that at least part of the constituent in question is no longer trapped in the matrix formed by the other constituents, but is released. In the example of concrete, the fragmentation force thus allows to release, for example, the gravel particles from the mortar. In other words, the majority, if not all, of the gravel particles are individualised. Fragments of mortar may remain attached to the surface of the gravel particles, or may still connect gravel particles together. However, the amount of particles that are still interconnected by mortar is much less than the amount of individualised particles. Gravel particles may have been fragmented under the effect of the fragmentation force, but for a minority of the gravel particles. In other words, the gravel particles released and recovered are, for the most part, the original gravel particles, that is to say, those that were in the original concrete.

For example, to dissociate gravel from mortar, the target fragmentation force can be determined by theoretical calculation. Indeed, the compressive strength of the mortar is generally less than that of the gravel, so that it is possible to calculate a target fragmentation force allowing to break the mortar while limiting, or even avoiding, the fragmentation of the gravel. Generally, the target fragmentation force can be determined from the features of the constituents of the material to be fragmented.

It is also possible to calculate a target force corresponding to the bonding force between the gravel particles and the mortar, the target fragmentation force being greater than the bonding force but less than the limit compressive force of the gravel.

It is also possible to determine the target fragmentation force experimentally, on a sample of the initial concrete.

According to one embodiment, the target fragmentation force is reached by iteration, starting from an initial force of the machine and regulating it by acting on the speed of rotation of the vibrators or by acting on the phase shift between the vibrators until obtaining the dissociation between gravel and mortar.

For example, the fragmentation force is regulated from the ratio between gravel and mortar. Indeed, the proportion between gravel and mortar for a type of concrete is generally known. Thus, it is possible to determine a theoretical ratio depending on the type of concrete feeding the fragmentation machine 1. Once the concrete is fragmented in the machine 1, the fragmented material is recovered, and it is subjected to sorting according to a criterion allowing to separate the gravel from the mortar. Typically, the sorting can be a screening with a criterion on the size of the particles adapted to the recovery of the gravel, the particles of which are of sizes greater than those of the mortar. Two fractions are thus obtained after screening. By determining an actual ratio between these two fractions and comparing it with the theoretical ratio, the fragmentation force deployed by the machine can be regulated by approaching the actual ratio to the theoretical ratio.

It is also possible to use a criterion other than that of the ratio between gravel and mortar. For example, the presence of mortar implies an absorption of water all the more significant as the amount of mortar is significant. Thus, by evaluating at the output of the fragmentation machine 1 and after sorting, the amount of water absorbed by the fraction supposed to comprise the gravel, an evaluation of the amount of mortar which remains attached to the gravel is obtained, and the fragmentation force of the fragmentation machine 1 can be adjusted accordingly.

The adjustment of the fragmentation force by the speed or the phase shift of the vibrators 8*a*, 8*b*, 8*c*, 8*d* on the machine 1 as shown above allows to carry out a particularly reactive method, the fragmentation force deployed by the machine being modified in few seconds, without having to stop the machine or the material feed. Furthermore, thanks to the adjustment of the speed and phase shift of the vibrators 8*a*, 8*b*, 8*c*, 8*d*, it is possible to obtain a wide range of values for the fragmentation force deployed by the machine 1.

However, the method can be implemented on any material-bed compression and inertial fragmentation machine wherein the speed and/or the phase shift of the vibrators are manually or automatically adjustable during operation of the machine or at stop.

Figure 3:
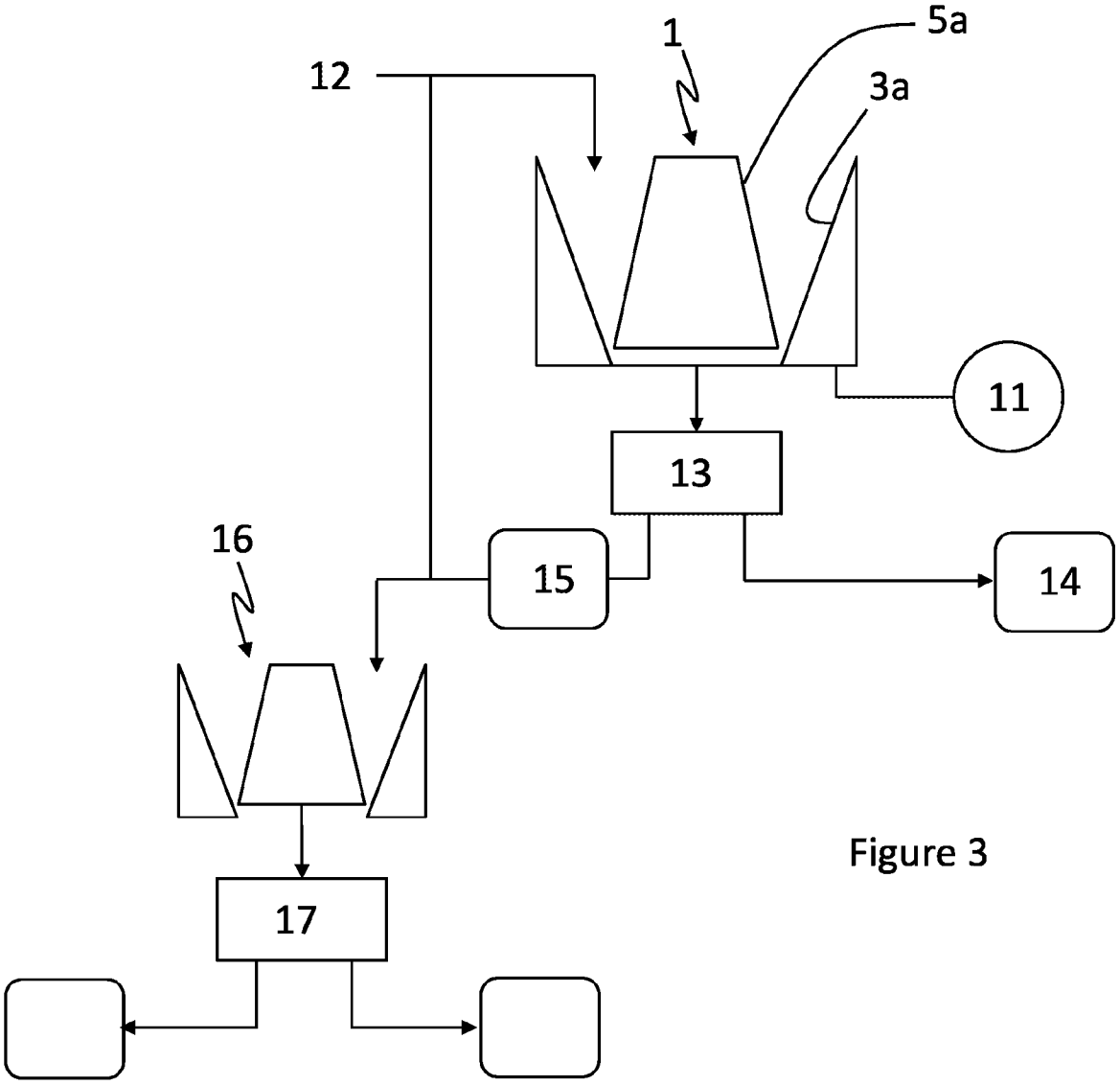
FIG. 3 is a schematic representation of different steps of an embodiment of the method according to the invention.

FIG. 3 illustrates an example of the implementation of the method according to the invention on the machine 1 presented above.

Figure 4:
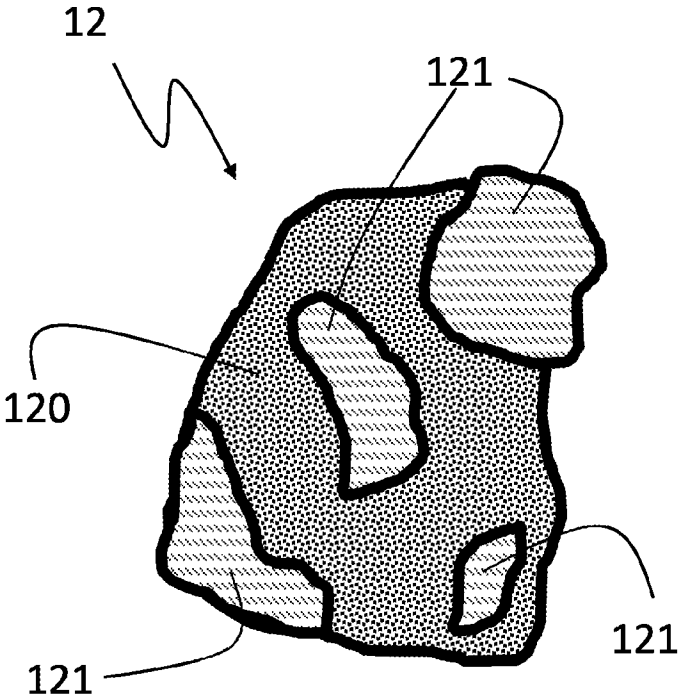
FIG. 4 is an illustration showing an example of a heterogeneous material.

More specifically, the material 12 to be fragmented comprises at least two constituents, as schematically illustrated in FIG. 4. According to the example of concrete which is described here, the material 12 to be fragmented comprises a matrix 120 composed of the mortar, that is to say a mixture of sand and cement paste, and gravel particles 121 trapped in the mortar, that is to say that the surface of the gravel particles 121 is bonded to the mortar.

The material 12 passes between the internal fragmentation track 3*a* and the external fragmentation track 5*a*. The pressure exerted by the material bed on the mortar and the gravel allows to break the bond between the gravel particles and the mortar, releasing the gravel. The fragmented material is then subjected to sorting in a sorting device 13, for example based on size, it being expected that the gravel particles are of a size greater than those of the mortar. At the output of the sorting device 13, two fractions are recovered: a first fraction 14 comprising the particles of larger size, and called coarse fraction, and a second fraction 15 comprising the finer particles, called fine fraction.

The coarse fraction 14 thus comprises the gravel released from the mortar, and preferably gravel for the most part relative to the mortar. More specifically, mortar can stick to some gravel particles. However, by the flexibility of the fragmentation force adjustment of the machine, it is possible to determine an acceptable rate for the presence of mortar in the coarse fraction 14. Generally, the proportion of mortar varies between 10% and 70% by mass in the concrete feeding the fragmentation machine 1. After fragmentation, the coarse fraction can then contain less than 10% and preferably less than 5% by mass of mortar.

The fine fraction 15 then comprises mainly, and preferably exclusively, mortar which is in turn a mixture of sand and cement paste. Thus, in order to recover the sand, the fine fraction 15 can be sent to a second fragmentation machine 16, substantially similar to the machine 1 already described above, in order to dissociate the sand from the cement paste. As previously, the material recovered at the output of the second fragmentation machine 16 is subjected to sorting in a second sorting device 17 with a sorting criterion adapted for the separation between the sand and the cement paste. The passage in the second fraction machine 16 is optional, because it is possible that all the aggregate, that is to say the sand and the gravel, has already been sufficiently dissociated from the cement paste in the first fragmentation machine 1 so that the fine fraction 15 can be sent directly to the second sorting device 17. The sorting criterion can again be based on the size. Two fractions are then recovered again, namely a fraction comprising particles of a size greater than a given value corresponding to the minimum size expected for sand and another fraction comprising particles of a size smaller than this given value.

According to one embodiment, all or part of the fragmented material is recirculated, that is to say after it has passed through the fragmentation machine 1, in particular in order to homogenise the compression forces by multiplying the compression points on the gravel particles and therefore limit the production of particles with a particle size smaller than the expected particle size of the gravel.

More specifically, for example, part of the fragmented material is recovered directly from the output of the fragmentation machine 1 and returned to the feed of the machine 1.

Alternatively or in combination, the fragmented material is subjected to a sorting step, and all or part of one or more fractions recovered after sorting is returned to the feed of the machine 1.

In addition, the recirculation of a fraction to the machine 1 can be performed to improve what is called the flattening coefficient. The flattening coefficient allows to characterise the shape of particles, in particular for gravel particles in the field of cement concrete. However, this notion can be extended to all heterogeneous artificial materials. The flattening coefficient in particular gives an indication on the fragility of the gravel. Indeed, the more the shape is elongated and flat, the more the particle is fragile, ultimately making the concrete fragile. Thus, the higher the flattening coefficient, the more fragile the particles. Therefore, it is possible to determine a target value, or in any case a maximum value, for the expected flattening coefficient, for example for the gravel at the output of the machine. By measuring the flattening coefficient of the gravel after fragmentation, it is then possible to adjust the flow rate and/or the granulometry range of each fraction recirculated depending on the difference between the determined flattening coefficient and the measured flattening coefficient.

In addition, the recirculation, in particular of the fine fraction 15 in the case of concrete, can also promote the phenomenon of attrition, in particular on the mortar stuck to the gravel particles in the case of concrete, so as to improve the release of the gravel. For example, a cleaning rate can be defined which characterises the amount of mortar remaining attached to the gravel particles. For example, this may be the mass of mortar that is recovered by different techniques, such as scraping or chemical cleaning, on a sample of gravel particles. The cleaning rate can also be defined from the water demand. Thus, it is possible to determine a cleaning rate to be achieved, then to measure this cleaning rate on the gravel after fragmentation. The flow rate and/or the granulometry range of each recirculated fraction are then adjusted depending on the difference between the determined cleaning rate and the measured cleaning rate.

Alternatively or in combination, an adjuvant can be added to the feed of the fragmentation machine 1 in order to facilitate the dissociation between the gravel and the mortar. The adjuvant can have the effect, for example, of weakening the bond between the mortar and the gravel, or of preventing particles, both gravel and mortar, from clumping together, thus facilitating any screening.

The fragmentation machine 1 can easily be adjusted so as to obtain the desired result. The method thus allows to reliably obtain a fraction comprising gravel that can be used directly in the formulation of new concrete, without an additional cleaning step. The machine also allows to recover a fraction comprising sand and a fraction comprising cement paste, which can in turn be reused in the formulation of new concrete.

Although the description relates to the example of cement concrete, in particular thanks to the flexibility in the adjustment of the fragmentation force, the method can be implemented on any heterogeneous artificial material.

The invention claimed is:

1. A method for dissociating different constituents of heterogeneous artificial material via fragmentation by material-bed compression, the method comprising:

using a fragmentation machine (1) equipped with a tank (3) forming an internal fragmentation track (3*a*) about a longitudinal axis of the machine (1), a hub (5) forming an external fragmentation track (5*a*) about a longitudinal axis of the machine (1), the hub (5) located inside the tank (3), plural vibrators that each rotate about a respective longitudinal axis of the machine (1), and each being connected to one of the tank (3) and the hub (5), and a control system (11);

rotating the plural vibrators of the fragmentation machine (1), such that the tank performs a movement relative to the hub (5) in a plane that is transverse to a longitudinal axis of the machine (1);

feeding the fragmentation machine (1) with the material to be fragmented; and fragmenting the material between the external fragmentation track (5*a*) and the internal fragmentation track (3*a*), wherein the control system (11) operates to control a parameter of the plural vibrators, said parameter being one of a speed of rotation of the plural vibrators and a relative phase shift angle between the plural vibrators, and wherein the control system adjusts the parameter of the plural vibrators so as to generate a fragmentation force by the machine (1) and thereby at least partially dissociate at least one constituent of the material from other constituents of the material.

2. The method according to claim 1, wherein the hub (5) is of a conical shape, and wherein the machine (1) further comprises:

a frame (2) configured to rest on a floor, the hub (5) being supported by the frame (2), and a chassis (4) movable in translation relative to the frame (2) at least in the plane of the machine (1) that is transverse to the longitudinal axis of the machine (1) relative to the frame (2), the tank being mounted on the movable chassis (4), at least one of the plural vibrators being mounted on the chassis (4).

3. The method according to claim 2, wherein the control system adjusts the parameter of the plural vibrators with the following steps:

determining a target ratio between at least one constituent of the material and the other constituents of the material;

recovering the material after fragmenting at an output of the fragmentation machine (1);

determining a sorting criterion allowing to separate the at least one constituent of the material from the other constituents of the material;

subjecting the material after fragmenting to a sorting by means of said sorting criterion determined so as to recover at least two fractions;

determining an actual ratio between the at least two fractions;

adjusting the parameter of the plural vibrators according to a difference between the target ratio and the actual ratio.

4. The method according to claim 2, wherein the control system adjusts the parameter of the plural vibrators with the following steps:

determining at least one property of at least one constituent of the material;

from said determined property, calculating a target force allowing to dissociate the at least one constituent of the material from the other constituents of the material;

adjusting the parameter of the plural vibrators to obtain the target force.

5. The method according to claim 2, wherein at least a portion of at least one fraction of the material, after fragmenting, is recovered and is recirculated to feed the fragmentation machine (1).

6. The method according to claim 1, wherein the hub (5) is of a conical shape, and wherein the machine (1) further comprises:

a frame (2) configured to rest on a floor, the hub (5) being supported by the frame (2), a chassis (4) movable in translation relative to the frame (2) at least in the plane of the machine (1) that is transverse to the longitudinal axis of the machine (1) relative to the frame (2), the tank being mounted on the movable chassis (4), the plural vibrators mounted on the chassis (4), each of the plural vibrators configured to be driven, independently from one another, by a respective motor (10), a device for managing the respective motors (10) of the plural vibrators, and a device for measuring the relative phase shift angle between the plural vibrators, wherein the parameter of the plural vibrators adjusted by the control system is the relative phase shift angle between the plural vibrators.

7. The method according to claim 6, wherein the control system adjusts the parameter of the plural vibrators with the following steps:

determining a target ratio between at least one constituent of the material and the other constituents of the material;

recovering the material after fragmenting at an output of the fragmentation machine (1);

determining a sorting criterion allowing to separate the at least one constituent of the material from the other constituents of the material;

subjecting the material after fragmenting to a sorting by means of said sorting criterion determined so as to recover at least two fractions;

determining an actual ratio between the at least two fractions;

adjusting the parameter of the plural vibrators according to a difference between the target ratio and the actual ratio.

8. The method according to claim 6, wherein the control system adjusts the parameter of the plural vibrators with the following steps:

determining at least one property of at least one constituent of the material;

from said determined property, calculating a target force allowing to dissociate the at least one constituent of the material from the other constituents of the material;

adjusting the parameter of the plural vibrators to obtain the target force.

9. The method according to claim 6, wherein at least a portion of at least one fraction of the material, after fragmenting, is recovered and is recirculated to feed the fragmentation machine (1).

10. The method according to claim 1, wherein the control system adjusts the parameter of the plural vibrators with the following steps:

determining a target ratio between the at least one constituent of the material and the other constituents of the material;

recovering the material after fragmenting at an output of the fragmentation machine (1);

determining a sorting criterion allowing to separate the at least one constituent of the material from the other constituents of the material;

subjecting the material after fragmenting to a sorting by means of said sorting criterion determined so as to recover at least two fractions;

determining an actual ratio between the at least two fractions;

adjusting the parameter of the plural vibrators according to a difference between the target ratio and the actual ratio.

11. The method according to claim 10, wherein the control system adjusts the parameter of the plural vibrators with the following steps:

determining at least one property of at least one constituent of the material;

from said determined property, calculating a target force allowing to dissociate the at least one constituent of the material from the other constituents of the material;

adjusting the parameter of the plural vibrators to obtain the target force.

12. The method according to claim 10, wherein at least a portion of at least one fraction of the material, after fragmenting, is recovered and is recirculated to feed the fragmentation machine (1).

13. The method according to claim 1, wherein the control system adjusts the parameter of the plural vibrators with the following steps:

determining at least one property of the at least one constituent of the material;

from said determined property, calculating a target force allowing to dissociate the at least one constituent of the material from the other constituents of the material;

adjusting the parameter of the plural vibrators to obtain the target force.

14. The method according to claim 1, wherein at least a portion of at least one fraction of the material, after fragmenting, is recovered and is recirculated to feed the fragmentation machine (1).

15. The method according to claim 14, further comprising the following steps:

determining a target for a flattening coefficient for at least one constituent of the material to be fragmented;

recovering the at least one constituent after fragmenting;

measuring said flattening coefficient of the at least one constituent;

adjusting any of a flow rate and a granulometry range of the at least one fraction that is recirculated depending on a difference between the determined target for the flattening coefficient and the measured flattening coefficient.

16. The method according to claim 14, further comprising the following steps:

determining a target of a cleaning rate for at least one constituent of the material to be fragmented;

recovering the at least one constituent after fragmentation;

measuring said cleaning rate of the at least one constituent;

adjusting any of a flow rate and a granulometry range of the at least one fraction recirculated depending on a difference between the determined target of the cleaning rate and the measured cleaning rate.

17. The method according to claim 1, wherein the material to be fragmented is concrete and comprises gravel as a first constituent of the material and mortar as a second constituent of the material, the gravel being trapped in the mortar, and wherein the method further comprises:

determining a target of the fragmentation force generating a constraint in the bed-material greater than or equal to a compressive strength of the concrete.

18. The method according to claim 1, wherein the material to be fragmented is concrete and comprises gravel as a first constituent of the material and mortar as a second constituent of the material, the gravel being trapped in the mortar, and wherein the method further comprises:

recovering the gravel and the mortar at an output of the fragmentation machine;

subjecting the gravel and the mortar to a sorting between coarse particles of a size greater than a given value corresponding to the minimum expected size of the gravel and fine particles of a size less than said given value.

19. The method according to claim 18, further comprising the following step:

subjecting the fine particles resulting from said sorting to a second sorting to separate particles of a size greater than a second given value corresponding to a minimum expected size for sand, and particles of a size less than said second given value.

20. The method according to claim 18, further comprising the following step:

subjecting the fine particles resulting from said sorting to a second fragmentation step and to a sorting step to separate particles of a size greater than a second given value corresponding to a minimum expected size for sand and particles of a size less than said second given value.

21. A method for dissociating different constituents of heterogeneous artificial material via fragmentation by material-bed compression, the method comprising:

using a fragmentation machine (1) equipped with a tank (3) forming an internal fragmentation track (3*a*) about a longitudinal axis of the machine (1), a hub (5) forming an external fragmentation track (5*a*) about a longitudinal axis of the machine (1), the hub (5) located inside the tank (3), plural vibrators that each rotate about a respective longitudinal axis of the machine (1), and each being connected to one of the tank (3) and the hub (5), and a control system (11);

rotating the plural vibrators of the fragmentation machine (1), such that the tank performs a movement relative to the hub (5) in a plane that is transverse to a longitudinal axis of the machine (1);

feeding the fragmentation machine (1) with the material to be fragmented; and fragmenting the material between the external fragmentation track (5*a*) and the internal fragmentation track (3*a*), wherein the control system (11) operates to control parameters of the plural vibrators, said parameters being of both a speed of rotation of the plural vibrators and a relative phase shift angle between the plural vibrators, and wherein the control system adjusts the parameters of the speed of rotation and the relative phase shift angle so as to generate a fragmentation force by the machine (1) and thereby at least partially dissociate at least one constituent of the material from other constituents of the material.

22. The method according to claim 21, wherein the hub (5) is of a conical shape, and wherein the machine (1) further comprises:

a frame (2) configured to rest on a floor, the hub (5) being supported by the frame (2), and a chassis (4) movable in translation relative to the frame (2) at least in the plane of the machine (1) that is transverse to the longitudinal axis of the machine (1) relative to the frame (2), the tank being mounted on the movable chassis (4), at least one of the plural vibrators being mounted on the chassis (4).

23. The method according to claim 22, wherein the control system adjusts the parameter of the plural vibrators with the following steps:

determining a target ratio between at least one constituent of the material and the other constituents of the material;

recovering the material after fragmenting at an output of the fragmentation machine (1);

determining a sorting criterion allowing to separate the at least one constituent of the material from the other constituents of the material;

subjecting the material after fragmenting to a sorting by means of said sorting criterion determined so as to recover at least two fractions;

determining an actual ratio between the at least two fractions;

adjusting the parameter of the plural vibrators according to a difference between the target ratio and the actual ratio.

24. The method according to claim 22, wherein the control system adjusts the parameter of the plural vibrators with the following steps:

determining at least one property of at least one constituent of the material;

from said determined property, calculating a target force allowing to dissociate the at least one constituent of the material from the other constituents of the material;

adjusting the parameter of the plural vibrators to obtain the target force.

25. The method according to claim 22, wherein at least a portion of at least one fraction of the material, after fragmenting, is recovered and is recirculated to feed the fragmentation machine (1).

26. The method according to claim 21, wherein the hub (5) is of a conical shape, and wherein the machine (1) further comprises:

a frame (2) configured to rest on a floor, the hub (5) being supported by the frame (2), a chassis (4) movable in translation relative to the frame (2) at least in the plane of the machine (1) that is transverse to the longitudinal axis of the machine (1) relative to the frame (2), the tank being mounted on the movable chassis (4), the plural vibrators mounted on the chassis (4), each of the plural vibrators configured to be driven, independently from one another, by a respective motor (10), a device for managing the respective motors (10) of the plural vibrators, and a device for measuring the relative phase shift angle between the plural vibrators, wherein the parameter of the plural vibrators adjusted by the control system is the relative phase shift angle between the plural vibrators.

27. The method according to claim 26, wherein the control system adjusts the parameter of the plural vibrators with the following steps:

determining a target ratio between at least one constituent of the material and the other constituents of the material;

recovering the material after fragmenting at an output of the fragmentation machine (1);

determining a sorting criterion allowing to separate the at least one constituent of the material from the other constituents of the material;

subjecting the material after fragmenting to a sorting by means of said sorting criterion determined so as to recover at least two fractions;

determining an actual ratio between the at least two fractions;

adjusting the parameter of the plural vibrators according to a difference between the target ratio and the actual ratio.

28. The method according to claim 26, wherein the control system adjusts the parameter of the plural vibrators with the following steps:

determining at least one property of at least one constituent of the material;

from said determined property, calculating a target force allowing to dissociate the at least one constituent of the material from the other constituents of the material;

adjusting the parameter of the plural vibrators to obtain the target force.

29. The method according to claim 26, wherein at least a portion of at least one fraction of the material, after fragmenting, is recovered and is recirculated to feed the fragmentation machine (1).

30. The method according to claim 21, wherein the control system adjusts the parameter of the plural vibrators with the following steps:

determining a target ratio between the at least one constituent of the material and the other constituents of the material;

recovering the material after fragmenting at an output of the fragmentation machine (1);

determining a sorting criterion allowing to separate the at least one constituent of the material from the other constituents of the material;

subjecting the material after fragmenting to a sorting by means of said sorting criterion determined so as to recover at least two fractions;

determining an actual ratio between the at least two fractions;

adjusting the parameter of the plural vibrators according to a difference between the target ratio and the actual ratio.

31. The method according to claim 30, wherein the control system adjusts the parameter of the plural vibrators with the following steps:

determining at least one property of at least one constituent of the material;

from said determined property, calculating a target force allowing to dissociate the at least one constituent of the material from the other constituents of the material;

adjusting the parameter of the plural vibrators to obtain the target force.

32. The method according to claim 30, wherein at least a portion of at least one fraction of the material, after fragmenting, is recovered and is recirculated to feed the fragmentation machine (1).

33. The method according to claim 21, wherein the control system adjusts the parameter of the plural vibrators with the following steps:

determining at least one property of the at least one constituent of the material;

from said determined property, calculating a target force allowing to dissociate the at least one constituent of the material from the other constituents of the material;

adjusting the parameter of the plural vibrators to obtain the target force.

34. The method according to claim 21, wherein at least a portion of at least one fraction of the material, after fragmenting, is recovered and is recirculated to feed the fragmentation machine (1).

35. The method according to claim 34, further comprising the following steps:

determining a target for a flattening coefficient for at least one constituent of the material to be fragmented;

recovering the at least one constituent after fragmenting;

measuring said flattening coefficient of the at least one constituent;

adjusting any of a flow rate and a granulometry range of the at least one fraction that is recirculated depending on a difference between the determined target for the flattening coefficient and the measured flattening coefficient.

36. The method according to claim 34, further comprising the following steps:

determining a target of a cleaning rate for at least one constituent of the material to be fragmented;

recovering the at least one constituent after fragmentation;

measuring said cleaning rate of the at least one constituent;

adjusting any of a flow rate and a granulometry range of the at least one fraction recirculated depending on a difference between the determined target of the cleaning rate and the measured cleaning rate.

37. The method according to claim 21, wherein the material to be fragmented is concrete and comprises gravel as a first constituent of the material and mortar as a second constituent of the material, the gravel being trapped in the mortar, and wherein the method further comprises:

determining a target of the fragmentation force generating a constraint in the bed-material greater than or equal to a compressive strength of the concrete.

38. The method according to claim 21, wherein the material to be fragmented is concrete and comprises gravel as a first constituent of the material and mortar as a second constituent of the material, the gravel being trapped in the mortar, and wherein the method further comprises:

recovering the gravel and the mortar at an output of the fragmentation machine;

subjecting the gravel and the mortar to a sorting between coarse particles of a size greater than a given value corresponding to the minimum expected size of the gravel and fine particles of a size less than said given value.

39. The method according to claim 38, further comprising the following step:

subjecting the fine particles resulting from said sorting to a second sorting to separate particles of a size greater than a second given value corresponding to a minimum expected size for sand, and particles of a size less than said second given value.

40. The method according to claim 38, further comprising the following step:

subjecting the fine particles resulting from said sorting to a second fragmentation step and to a sorting step to separate particles of a size greater than a second given value corresponding to a minimum expected size for sand and particles of a size less than said second given value.

* * * * *